US009121666B2

(12) United States Patent
Ferrante

(10) Patent No.: US 9,121,666 B2
(45) Date of Patent: Sep. 1, 2015

(54) METHOD AND SYSTEM FOR AN OVER THE SHOULDER HOLSTER BELT

(76) Inventor: Tony John Ferrante, Tacoma, WA (US)

( * ) Notice: Subject to any disclaimer, the term of this patent is extended or adjusted under 35 U.S.C. 154(b) by 74 days.

(21) Appl. No.: 13/267,729

(22) Filed: Oct. 6, 2011

(65) Prior Publication Data

US 2012/0085802 A1 Apr. 12, 2012

Related U.S. Application Data

(60) Provisional application No. 61/391,469, filed on Oct. 8, 2010.

(51) Int. Cl.

| | |
|---|---|
| ***F41C 33/04*** | (2006.01) |
| *A45F 3/00* | (2006.01) |
| *A45F 3/02* | (2006.01) |
| *F41C 33/02* | (2006.01) |

(52) U.S. Cl.

CPC ..... *F41C 33/046* (2013.01); *A45F 2003/007* (2013.01); *A45F 2003/025* (2013.01); *F41C 33/0227* (2013.01); *F41C 33/0263* (2013.01)

(58) Field of Classification Search

CPC .... F41C 33/04; F41C 33/0227; F41C 3/0263; A45F 2003/007; A45F 2003/025

USPC ..... 224/587, 605, 625, 243

See application file for complete search history.

(56) References Cited

U.S. PATENT DOCUMENTS

| | | | | | |
|---|---|---|---|---|---|
| 4,346,827 | A * | 8/1982 | Bianchi et al. | ..... | 224/624 |
| 5,358,159 | A * | 10/1994 | Lundie, Jr. | ..... | 224/624 |
| 5,358,160 | A * | 10/1994 | Bianchi | ..... | 224/244 |
| 5,622,297 | A * | 4/1997 | Rogers et al. | ..... | 224/243 |
| 5,687,891 | A * | 11/1997 | Beletsky | ..... | 224/243 |
| 5,687,896 | A * | 11/1997 | Clift | ..... | 224/587 |
| 5,775,558 | A * | 7/1998 | Montalbano | ..... | 224/627 |
| 5,845,833 | A * | 12/1998 | Murphy | ..... | 224/625 |
| 5,927,574 | A * | 7/1999 | Ruesink | ..... | 224/149 |
| 6,149,042 | A * | 11/2000 | Rassias | ..... | 224/661 |
| 6,155,471 | A * | 12/2000 | Lichtenberger | ..... | 224/626 |
| 6,237,821 | B1 * | 5/2001 | Owen | ..... | 224/200 |
| 6,695,186 | B2 * | 2/2004 | Madarang | ..... | 224/587 |
| 6,719,178 | B1 * | 4/2004 | Taylor | ..... | 224/148.7 |
| 6,814,270 | B2 * | 11/2004 | Mason | ..... | 224/587 |
| 8,109,421 | B2 * | 2/2012 | McLean et al. | ..... | 224/270 |
| 8,302,830 | B1 * | 11/2012 | Jensen | ..... | 224/625 |
| 8,328,058 | B2 * | 12/2012 | Wilson | ..... | 224/625 |

* cited by examiner

*Primary Examiner* — Brian D Nash

(74) *Attorney, Agent, or Firm* — Foster Pepper PLLC; Richard T. Black

(57) ABSTRACT

An over the shoulder support system for concealed carry is disclosed. The system allows comfortable and discreet concealed carry of holstered weapons and associated materials, distributing load across one or both shoulders while allowing the entire system and supported weapon to remain concealed beneath clothing. The system can attach to a belt with j-hooks, and can attach directly to a wearer's clothing and/or to a holster.

3 Claims, 10 Drawing Sheets

METHOD AND SYSTEM FOR AN OVER THE SHOULDER HOLSTER BELT

PRIORITY CLAIM

This application claims the benefit of U.S. provisional application Ser. No. 61/391,469 filed Oct. 8, 2010; the foregoing application is incorporated by reference in its entirety as if fully set forth herein.

FIELD OF THE INVENTION

The present disclosure relates to methods, techniques, and systems for a firearm accessory and, in particular, to methods, techniques, and systems for a over the shoulder holster belt.

BACKGROUND OF THE INVENTION

Concealed carry enthusiasts spend a great deal of time and money attempting to find the most comfortable way to carry a concealed handgun. The weight of the handgun has always been a major factor in designing individual carry systems. When carrying a concealed handgun on your belt, the weight of the gun & holster pushes down on your belt and causes your belt and pants to sag and become uncomfortable. The only known solution is to over tighten your belt and/or pull up your pants several times a day. Alternate support systems are designed to be worn as an outermost garment, which by definition is not a concealed carry.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
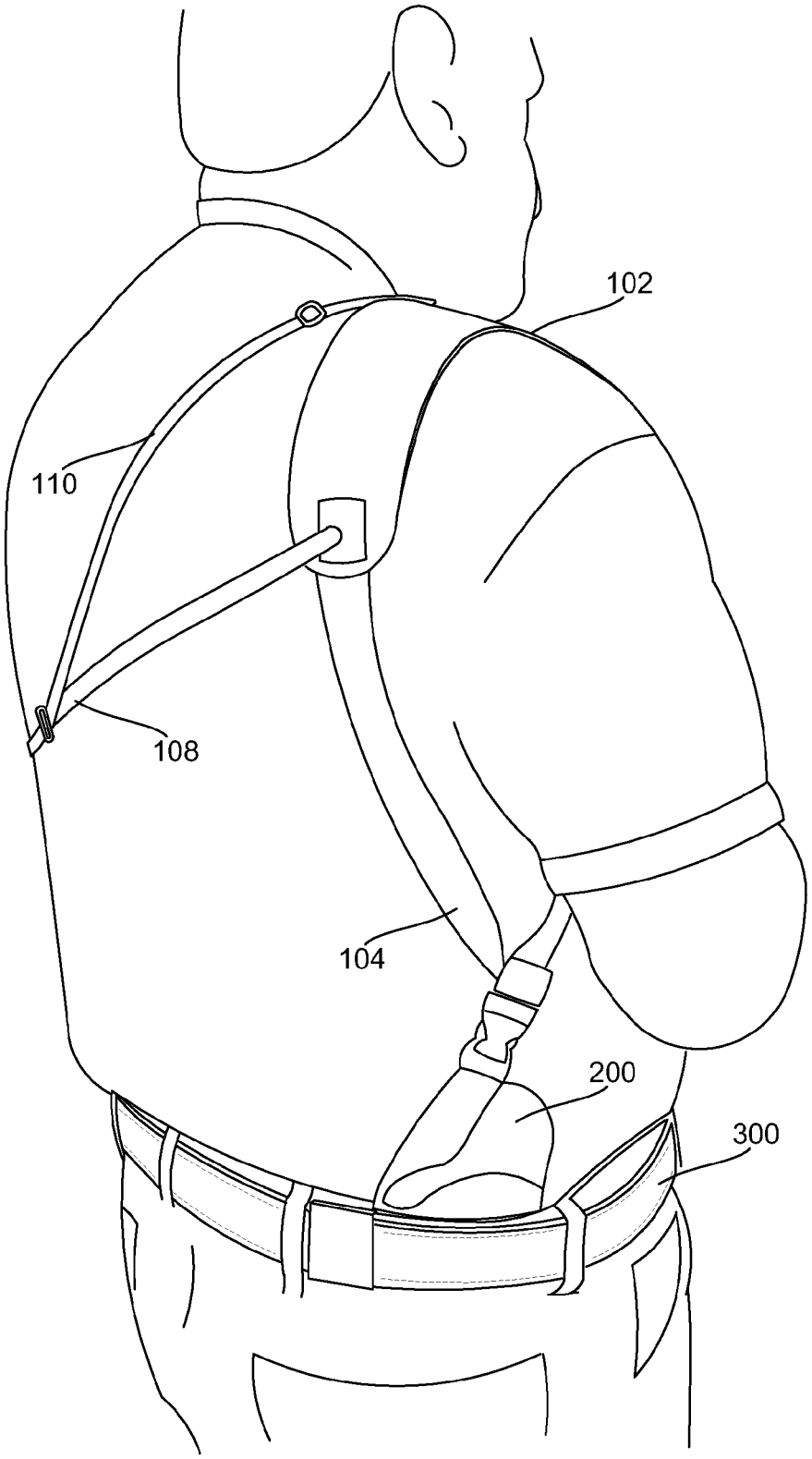
FIG. 1 is a rear side view of an embodiment of the present invention on a wearer.

Embodiments described herein provide enhanced methods, techniques, and systems for an over the shoulder concealed carry support system for supporting a weapon holster that is preferably worn in a concealed manner. Example embodiments provide a concealable, over the shoulder holster belt, which enables users to carry a concealed handgun on a belt or inside a waistband without the weight of the gun and/or holster pushing down on a pants belt.

Example embodiments further provide the ability to connect the over the shoulder holster belt to a holster and still allow for a wearer's shirt to be tucked in. The over the shoulder holster system is designed to relieve some of the weight of the gun and be worn under a garment, such that there is no visible sign of the over the shoulder system. The over the shoulder holster system is configured to be attached to standard inside the waist band (IWB) and outside the waistband (OWB) holsters and to provide a distributed support for their use in carrying a weapon.

In one example embodiment, the over the shoulder holster support system comprises one or more functional components that work together to attach the over the shoulder belt to a holster. The components allow for the attachment and the quick release of the holster from the belt. For example, an over the shoulder holster support system or a shoulder support may comprise a shoulder pad, holster support straps, chest strap, secondary shoulder straps and/or a tension strap. An example shoulder strap may consist of a shoulder pad (leather or other suitable material) worn on the same side of the body as a belt mounted handgun holster. For example, if the holster is worn in the right side, the shoulder pad would be worn on the right side. Example holster support straps include one or more adjustable straps that are configured to attach to the outermost edge of the shoulder pad and optionally run down along the outer edge of the chest, beside the arm and adjacent to the armpit and attach (directly or via a suitable snap fastener) to a belt mounted handgun holster. An example chest strap includes an adjustable tension strap that is preferably attached to a rear shoulder pad which runs across the wearer's back at approximately shoulder blade level around the wearer's side and above the hip and attaches to the front of the shoulder pad at the wearer's chest level. An example secondary shoulder strap attaches at the rear of the shoulder pad between the center of the shoulder pad and the chest strap attaching to the chest strap approximately at the center of the wearers back. An example support strap loops unobtrusively under the wearer's belt by a j-hook, thereby transferring downward load that might otherwise drag down the belt or pants to the shoulders. At the same time, the j-hook is unobtrusive, and can be so discreet as to be nearly invisible even when a shirt is tucked in.

In an embodiment, the device consists of two over-the-shoulder straps, which hook or clasp at four points, two front and two rear, thereby transferring the load of a weapon (and other belt-worn load such as ammunition clips) broadly and evenly across both shoulders. In an embodiment, a tension strap across the upper back helps keep the shoulder straps comfortably in place.

An example tension strap attaches to the center of the chest strap at the wearer's side and attaches to the wearer's undergarment via a suspender clasp (or other suitable clasp), or by a j-hook to the belt. This strap holds the chest strap in the proper position at the wearer's side and provides the correct tension to hold the shoulder pad firmly on the shoulder.

In one embodiment an example over the shoulder holster belt or a shoulder sling may comprise a sling, an optional shoulder pad, and/or an optional chest strap. An example sling may include a single adjustable strap that is attachable to a belt mounted handgun holster. The sling preferably runs up the wearer's back and crosses over the wearer's shoulder on the same side as the holster. The strap then preferably runs across the wearer's chest and attaches to the inside of a wearer's pants, or to a belt using a j-hook. Alternately, it can undergarment in the front of the wearer and in a comfortable position on the opposite side as the holster using a optional suspender clasp (or other suitable clasp).

For example, if the holster is worn on the right rear side, the strap will attach to the front left undergarment. An optional example shoulder pad may be attached to the strap to distribute weight across the shoulder area. An optional example chest strap includes an adjustable tension strap to preferably hold the main strap in proper position across the shoulder area may be attached to the rear portion of the main strap at the wearer's back at approximately shoulder blade level around the wearer's side and above the hip and attaching to the front of the main strap at the wearer's chest level.

Some existing holsters attach to a wearer's belt, for example by a loop on the holster through which the wearer's belt passes. Without additional support, the added weight of the holster and weapon drag down the belt. In embodiments of the present invention, the added weight is distributed to shoulders, in some embodiments by directly attaching a support strap to the holster to augment the weight-transferring function of the belt loop.

FIGS. 1-10 show examples of a shoulder support and/or a shoulder sling.

FIG. 1 shows an example of a shoulder support embodiment that for example comprises a shoulder pad 102, holster support strap 104, holster 200, chest strap 108, and secondary shoulder strap 110. In the embodiment of FIG. 1, the wearer is carrying his holster inside belt 300.

Figure 2:
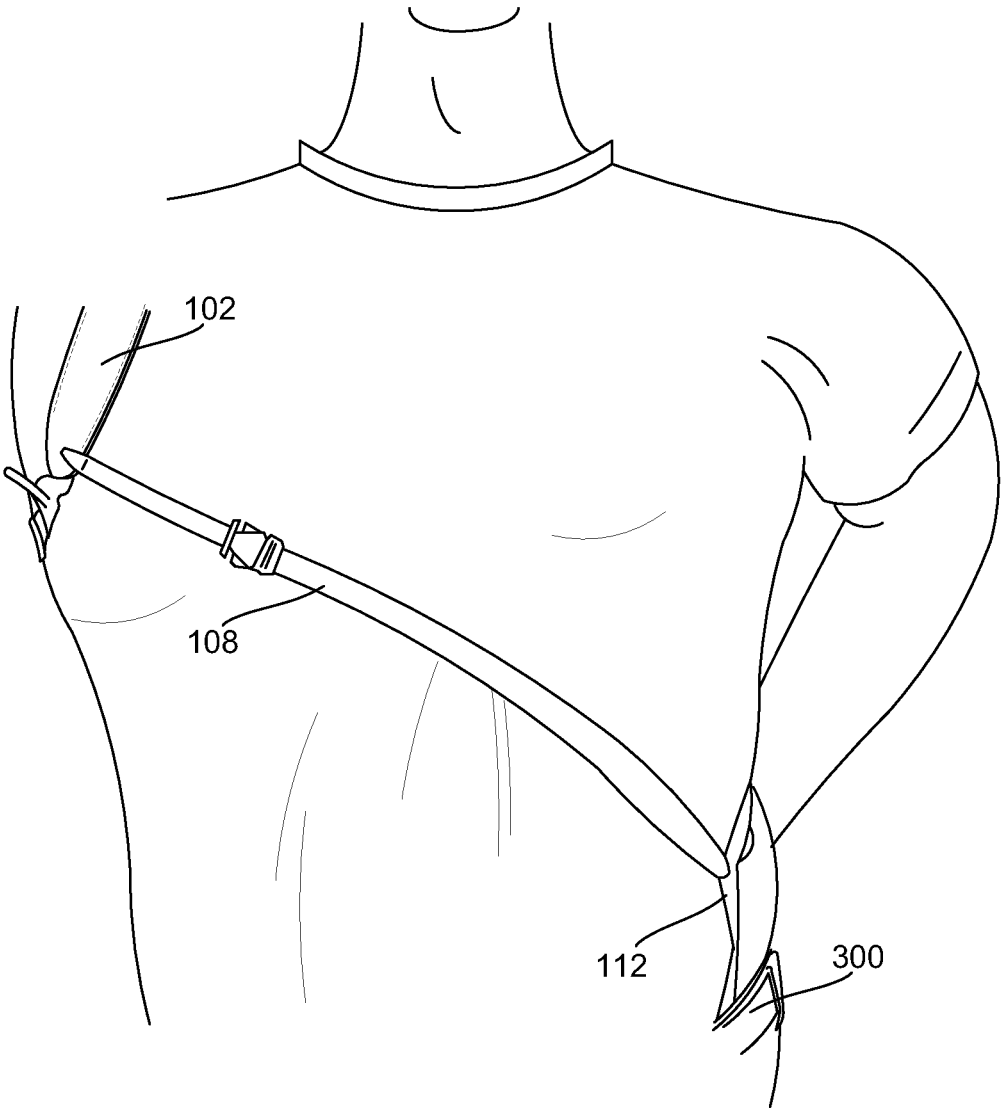
FIG. 2 is a front view of an embodiment of the present invention on a wearer.

FIG. 2 is a front view of an embodiment showing shoulder pad 102 and chest strap 108 passing around the body. In the embodiment of FIG. 2, the holster 200 (not shown) could be, for example, out of sight behind the wearer's back or to the wearer's side. Support strap 112 can attach to the wearer's clothing or the wearer's belt 300, for example via a j-hook, for added support.

Figure 3:
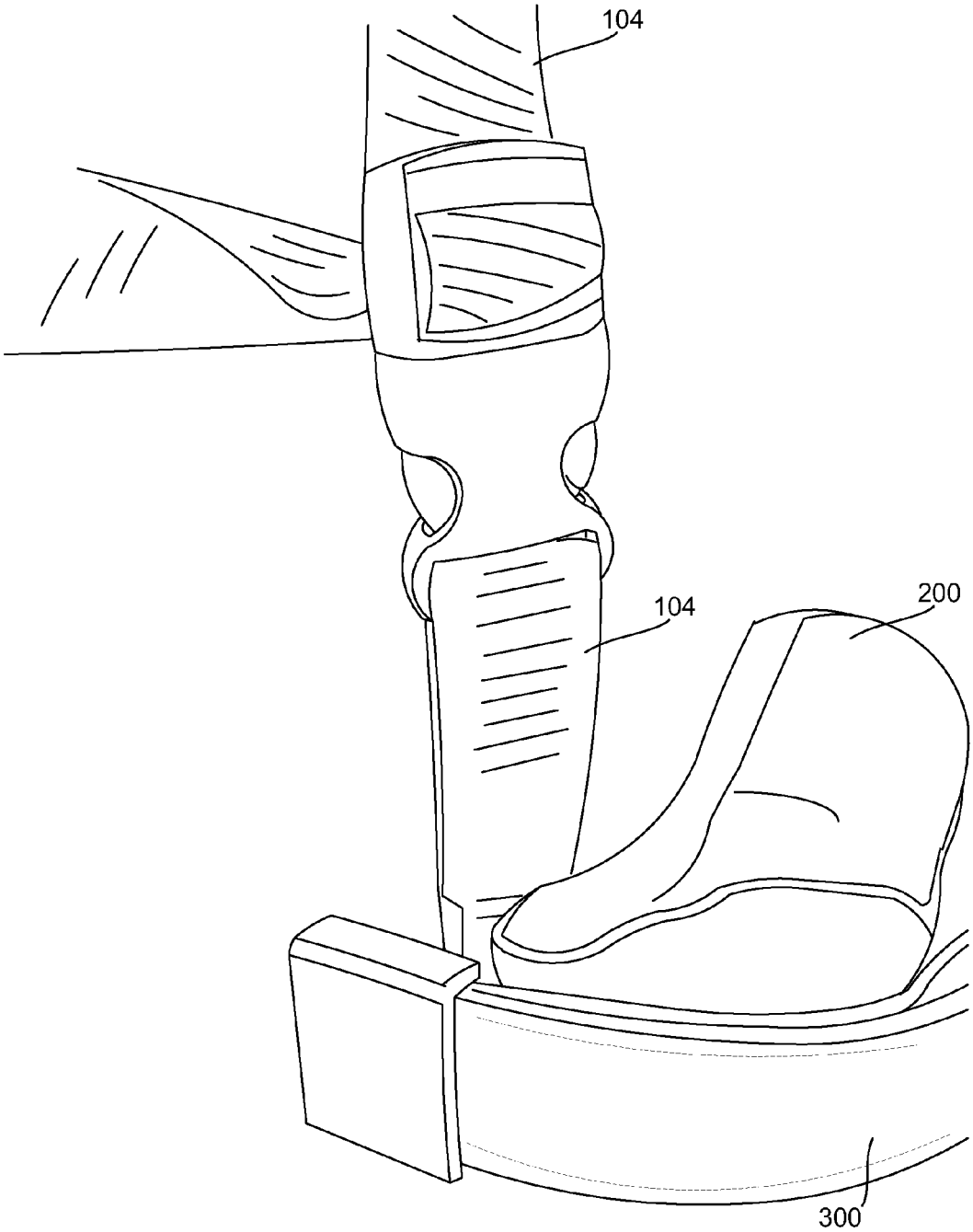
FIG. 3 is a view of an embodiment of the present invention showing a holster inside a wearer's belt.

FIG. 3 shows a closer view of an embodiment demonstrating holster support strap 104 passing through a buckle above the holster 200. Here again, the holster is carried inside the belt 300.

Figure 4:
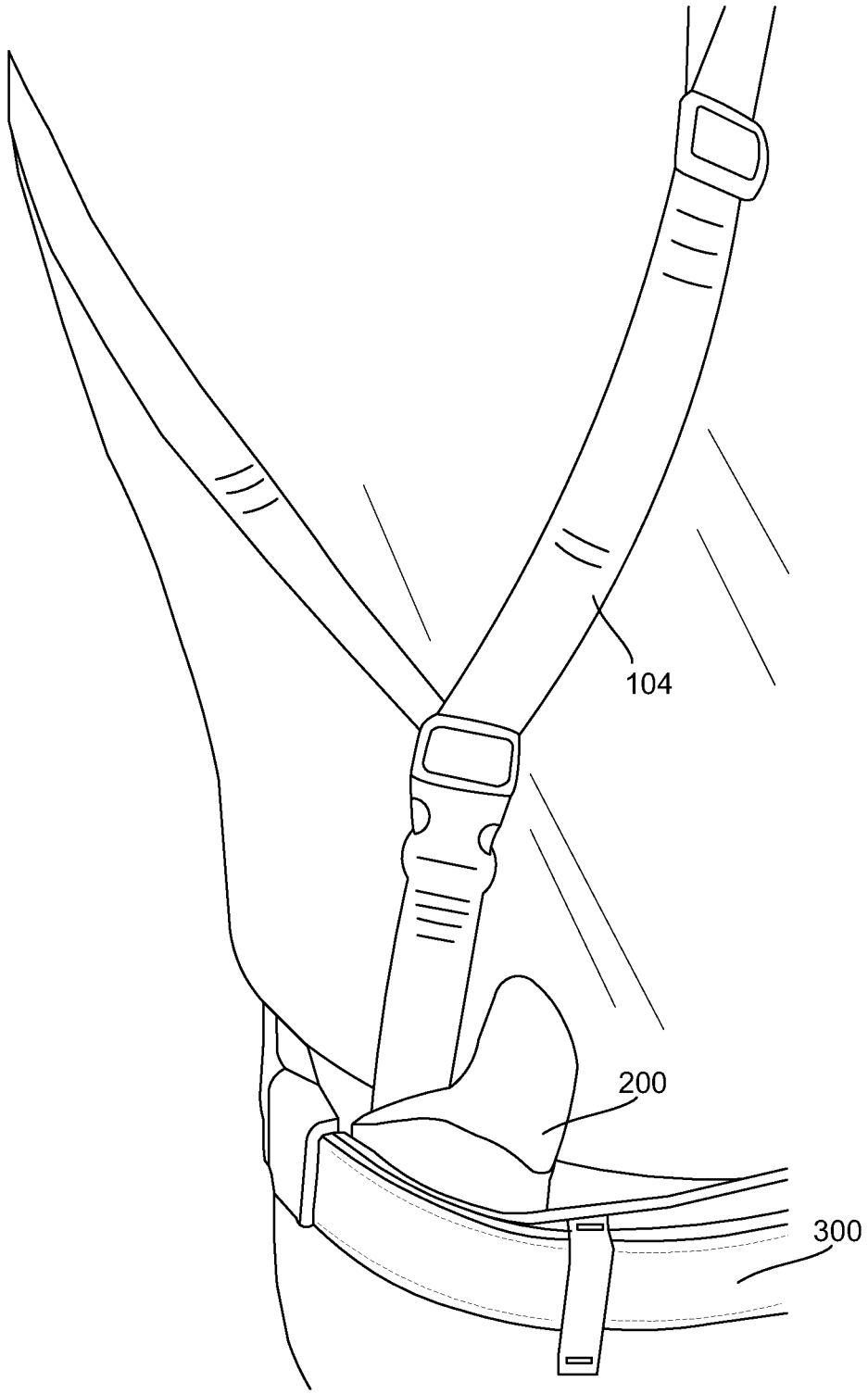
FIG. 4 is a rear view of an embodiment of the present invention on a wearer.

FIG. 4 shows holster support strap 104 above holster 200. Here again, the holster is carried inside the belt 300.

Figure 5:
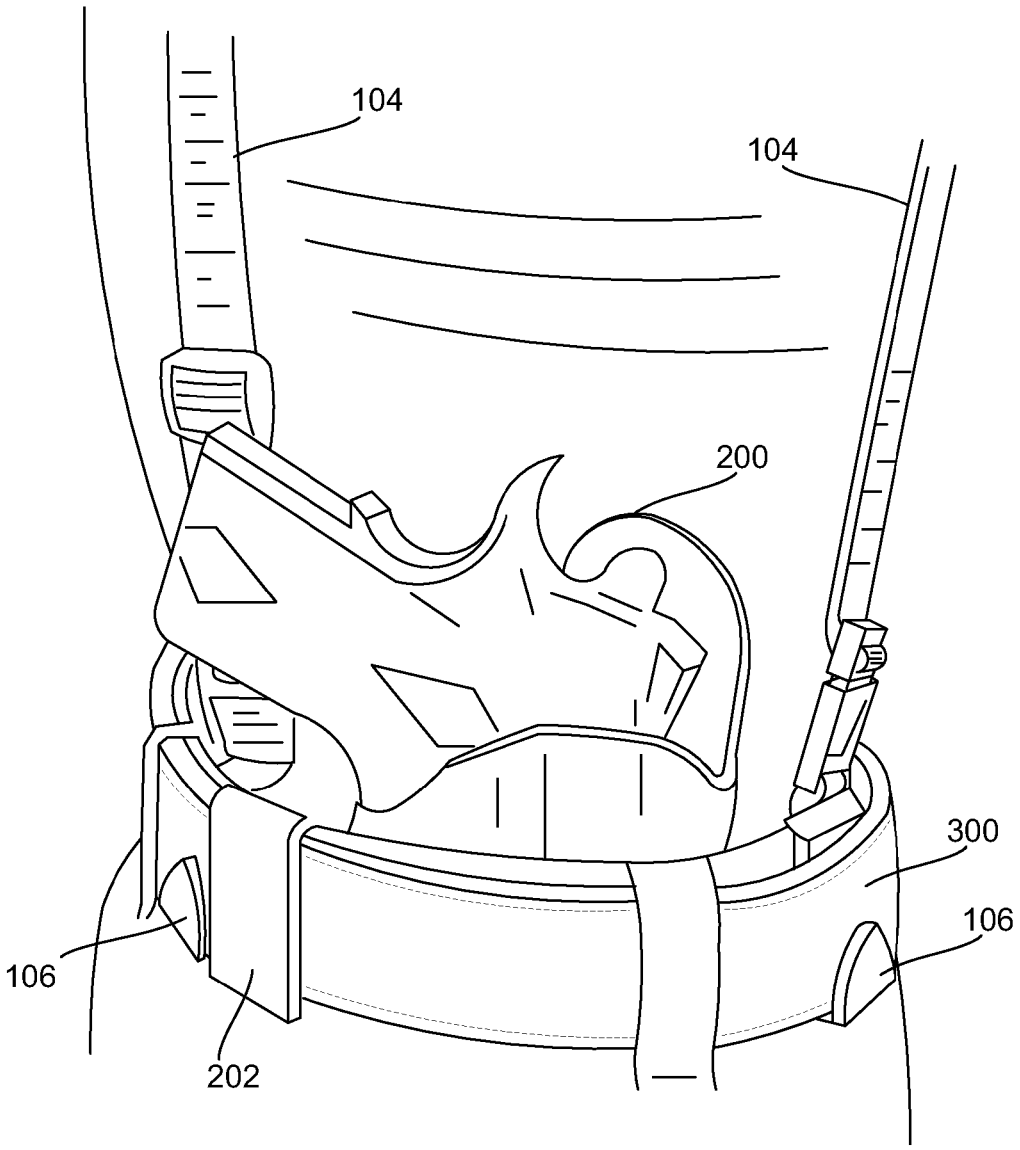
FIG. 5 is a side view of an embodiment of the present invention on a wearer.

FIG. 5 shows a side view of an embodiment with two holster support straps 104, showing j-hooks 106 looped under belt 300. Here, the holster 200 holds a weapon, and is attached to belt 300 by a belt loop 202 which forms part of the holster. In this two-shoulder-strap embodiment, similar straps and hooks (not shown) are found on the wearer's other side as well.

Figure 6:
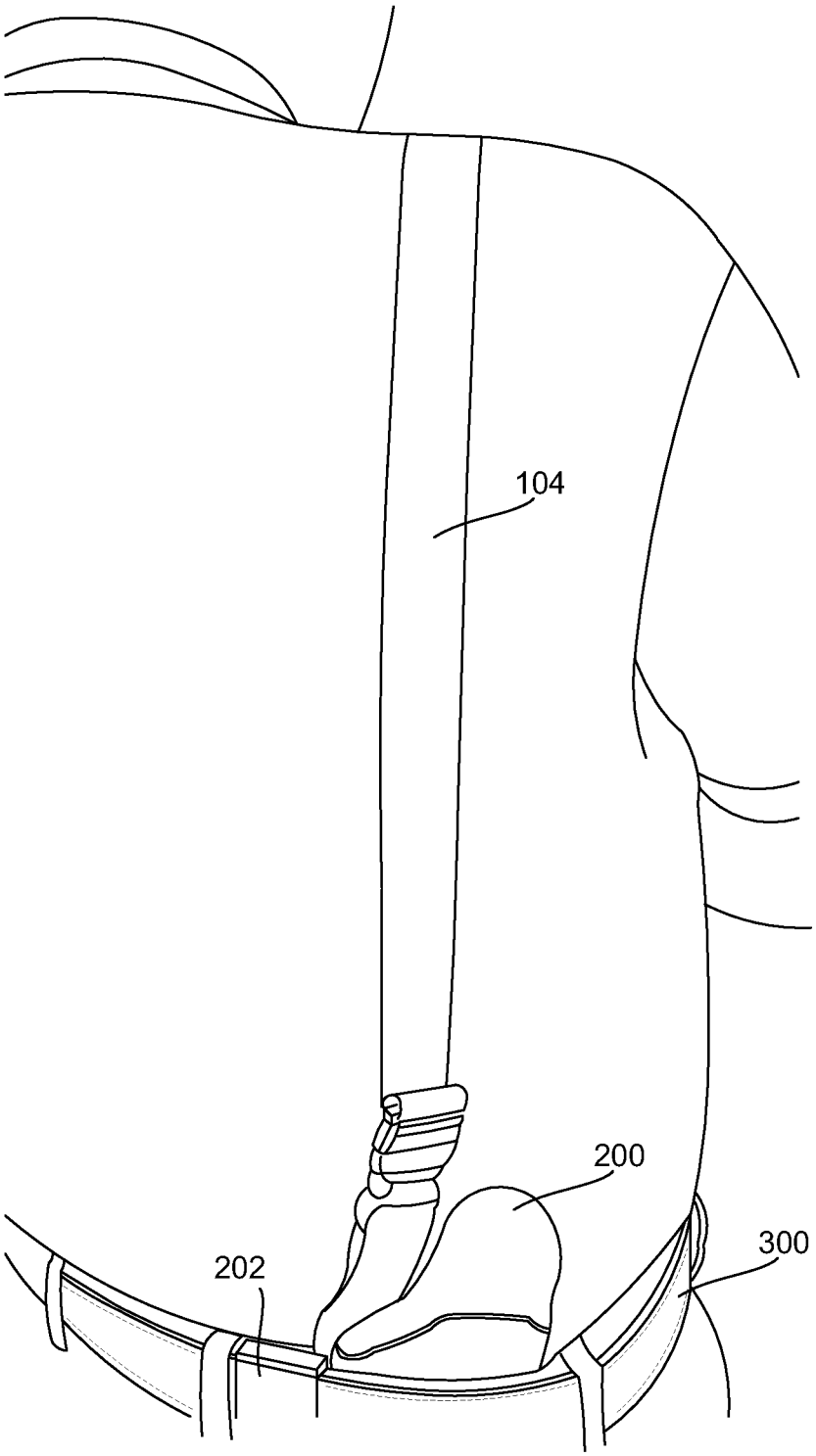
FIG. 6 is a rear view of an embodiment of the present invention on a wearer.

FIG. 6 shows an embodiment in which the holster 200 fastens directly to support strap 104. In such an embodiment, the holster may be attached to belt 300 by a belt loop 202.

Figure 7:
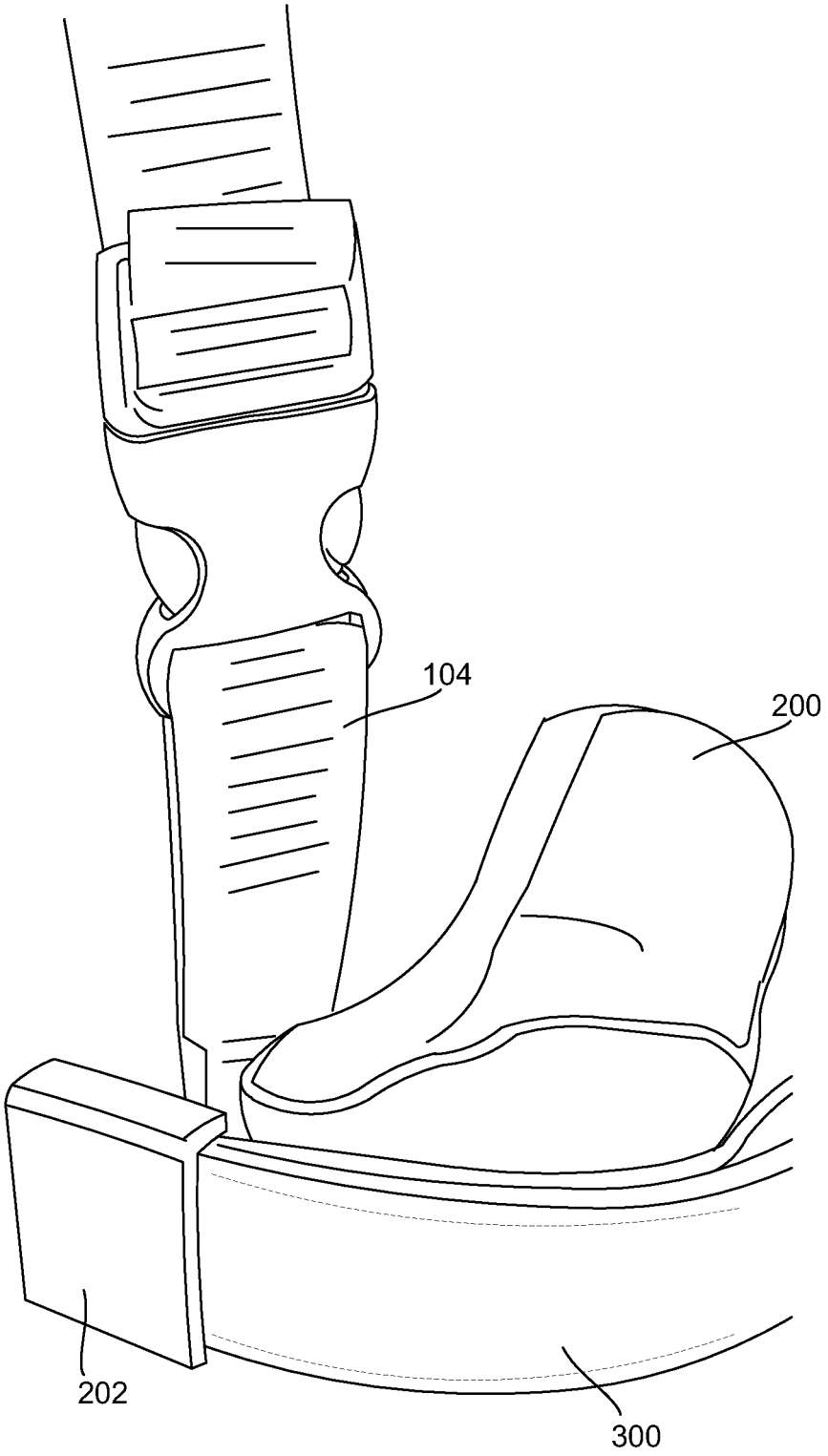
FIG. 7 is a view of an embodiment of the present invention showing a holster inside a wearer's belt.

FIG. 7 shows an embodiment where strap 104 fastens to holster 200 which is also connected to wearer's belt 300 by a belt loop 202. Strap 104 transfers to the shoulder some load that would otherwise be borne by belt 300.

Figure 8:
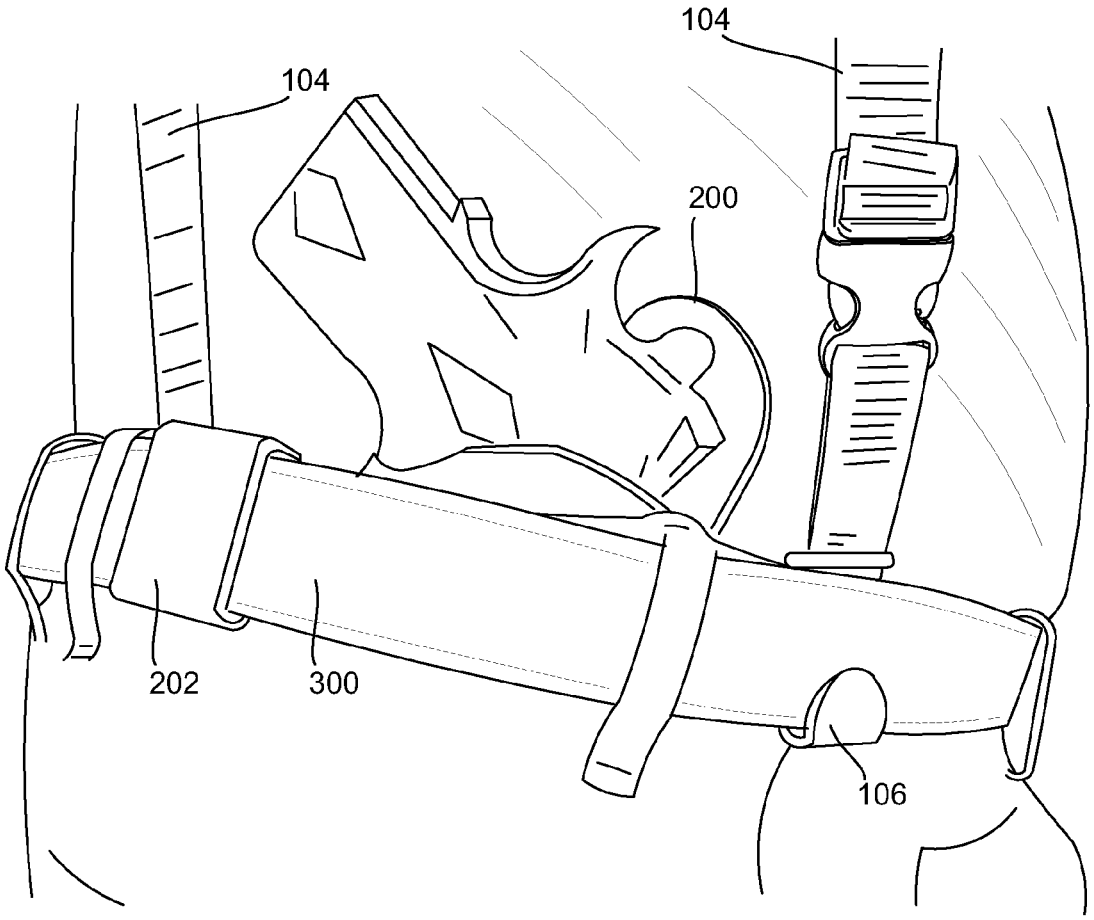
FIG. 8 is a view of an embodiment of the present invention showing a holster inside a wearer's belt.

FIG. 8 demonstrates an embodiment where one shoulder strap 104 supports belt 300 by a j-hook 106, while a second shoulder strap 104 attaches to the holster 200, which is also looped to belt 300 by belt loop 202.

Figure 9:
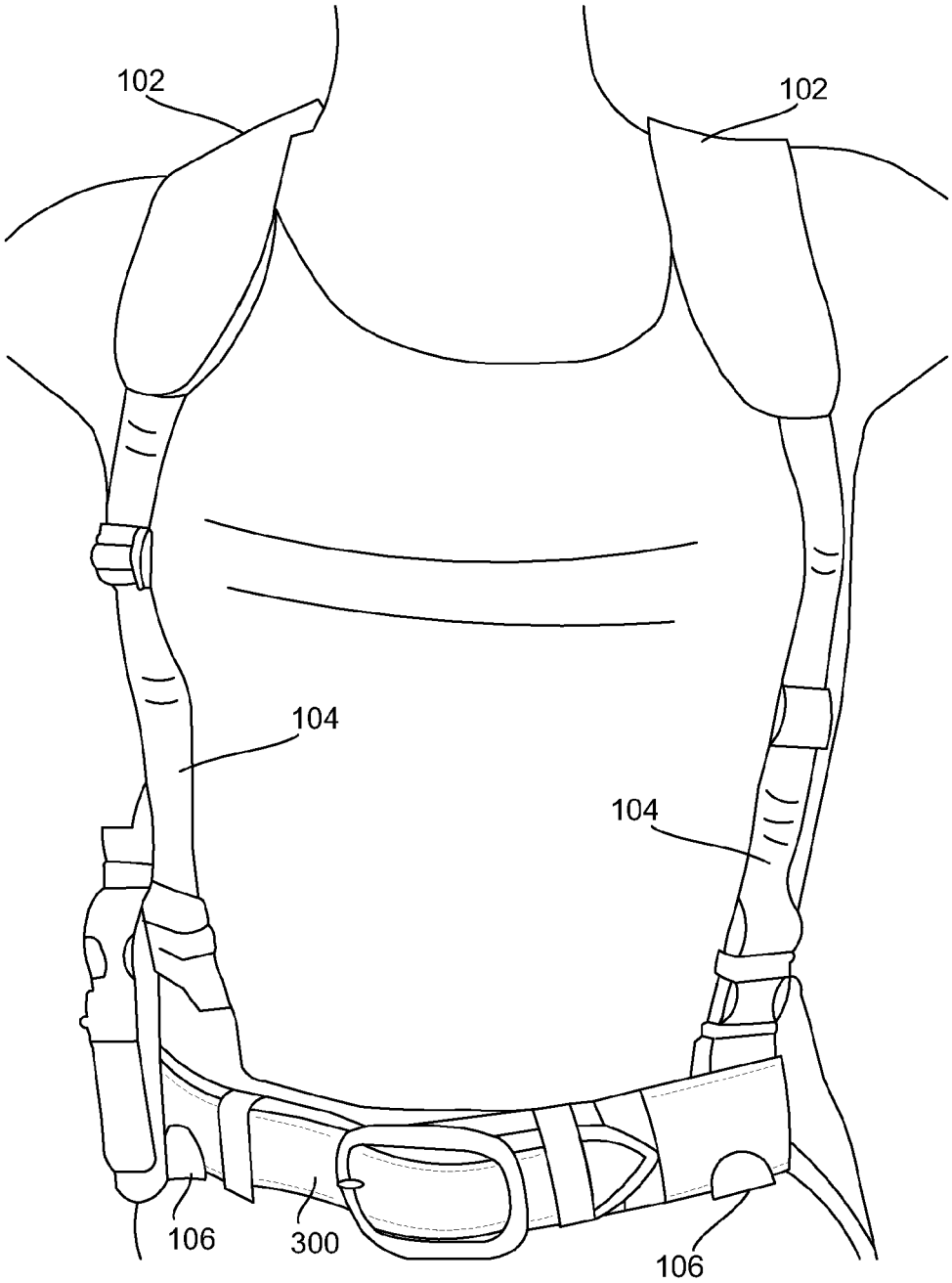
FIG. 9 is a front view of an embodiment of the present invention on a wearer.

FIG. 9 is a front view of a double strap embodiment, showing two shoulder pads 102, two straps 104, and two j-hooks 106 supporting the weight of the holster, which is shown worn outside belt 300.

Figure 10:
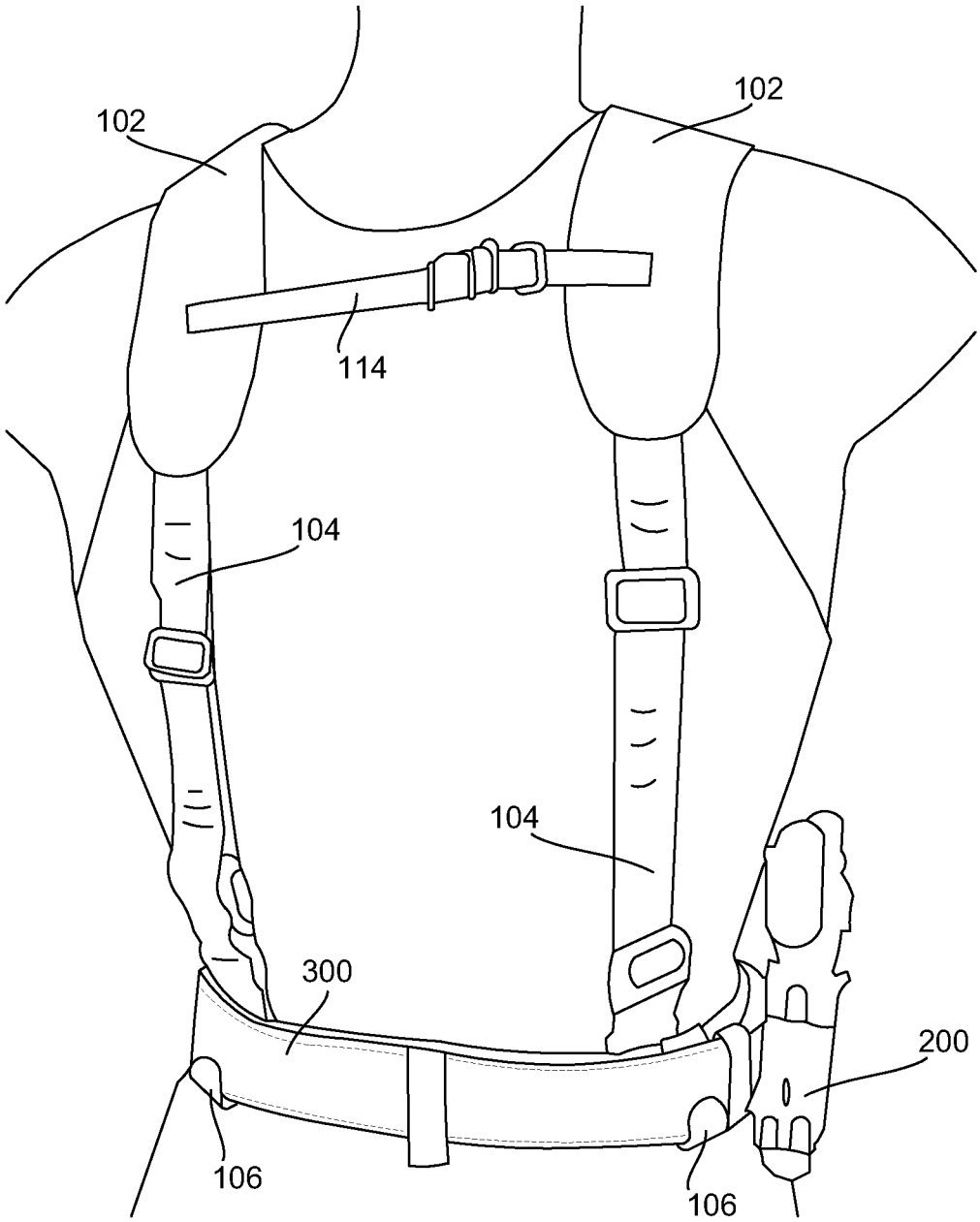
FIG. 10 is a rear view of an embodiment of the present invention on a wearer.

FIG. 10 is a rear view of the embodiment of FIG. 9, showing again two shoulder pads 102, two straps 104, and two j-hooks 106 supporting the weight of holster 200, again worn outside belt 300. Tension strap 114 between the shoulders adds additional sizing comfort as well as assisting in maintaining a comfortable wearing position and preventing shoulder pads 102 from slipping off the shoulders.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An over the shoulder holster support system comprising:

a holster attachment strap configured to secure the holster attachment strap to a holster at a distal end and having a sling attachment mechanism at a proximal end; and a sling configured to be slung over a shoulder of a weapon wearer while also concealed under a closed front upper body garment such as a shirt or blouse worn by the weapon wearer and configured to be:

detachably attachable at a first end to the sling attachment mechanism of the holster attachment strap; and detachably attachable opposite the holster to an open, non-enclosed J-shaped hook device which supports a lower body article of clothing on the weapon wearer so as to enable the removal of the lower body article of clothing of the weapon wearer without requiring removal of the upper body garment;

a shoulder pad attached to the sling and configured to be worn on the weapon wearer's shoulder to distribute weight across the shoulder area, wherein the said lower body article of clothing is an article selected from the group comprising a belt and pants; and a chest strap attached to a sling rear portion at the weapon wearer's back, and configured to wrap around the weapon wearer's side and attach to a sling front portion located on the weapon wearer's chest.

2. A holster support system comprising:

a shoulder pad configured to be concealed under an upper body garment worn by a weapon wearer;

a holster;

a holster support strap configured to be concealed under the upper body garment worn by a weapon wearer having a first end attached to the shoulder pad and having a second end; and a hook device having a bent portion configured to support a belt worn by, and supporting trousers worn by, the weapon wearer, wherein weight applied onto the belt by the holster is supported by the hook device and transferred to the holster support strap and to the shoulder pad; and wherein the hook device is further configured to detachably attach to the second end of the holster support strap, and to enable the removal of hook and belt without requiring removal of the upper body garment.

3. The holster support system of claim 2 wherein the upper body garment is a shirt, and further configured to provide the ability to connect the said holster support system to the hook device while still simultaneously allowing for the weapon wearer's shirt to be substantially tucked in to the trousers worn by the weapon wearer.

* * * * *